US005083682A

United States Patent [19]

Cater

[11] Patent Number: 5,083,682

[45] Date of Patent: * Jan. 28, 1992

[54] PUMP DISPENSER HAVING INLET AND OUTLET PORTS WHICH ARE HELD CLOSED DURING PERIODS OF NON USE

[75] Inventor: Miro S. Cater, Newtown, Conn.

[73] Assignee: American Dispensing Systems Inc., Edison, N.J.

[ * ] Notice: The portion of the term of this patent subsequent to Jun. 4, 2008 has been disclaimed.

[21] Appl. No.: 576,990

[22] Filed: Sep. 4, 1990

Related U.S. Application Data

[62] Division of Ser. No. 441,893, Nov. 27, 1989, Pat. No. 5,020,696.

[51] Int. Cl.[5] ..... B65D 83/64

[52] U.S. Cl. ..... 222/321; 222/341; 222/385; 222/400.5; 222/402.2

[58] Field of Search ..... 222/321, 341, 383, 385, 222/400.5, 401, 402.1, 402.2; 417/544; 237/333

[56] References Cited

U.S. PATENT DOCUMENTS

| | | | |
|---|---|---|---|
| 4,025,046 | 5/1977 | Boris | 222/385 X |
| 4,051,983 | 10/1977 | Anderson | 222/321 |
| 4,089,442 | 5/1978 | Hafele et al. | 222/321 |
| 4,274,560 | 6/1981 | Cater | 222/321 |
| 4,941,595 | 7/1990 | Montaner et al. | 222/321 |
| 5,016,780 | 5/1991 | Moretti | 222/321 X |
| 5,020,696 | 6/1991 | Cater | 222/321 |

*Primary Examiner*—Michael S. Huppert
*Assistant Examiner*—Philippe Derakshani

[57] ABSTRACT

An atomizing fluid dispenser has a pump chamber defined by a hollow vertical region defined by adjacent portions of interconnected upper and lower cylinders, a vertical member and a piston. The chamber has a first fluid entry port and a second fluid discharge port. The second port is opened and the first port is closed during a downstroke and the first port is opened and the second port is closed during an upstroke. Both ports are closed during periods of non use.

4 Claims, 4 Drawing Sheets

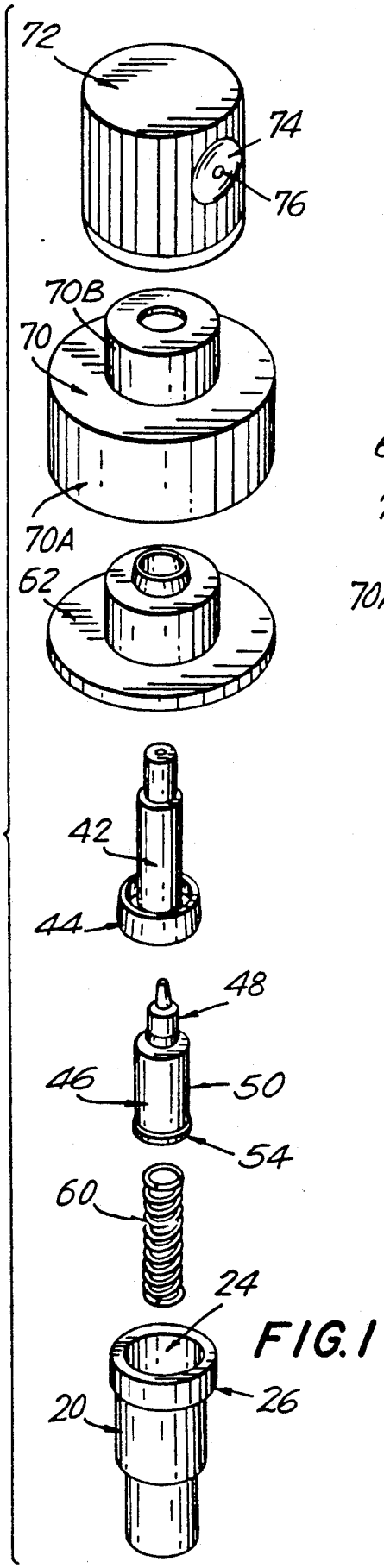
FIG. 1
FIG. 2
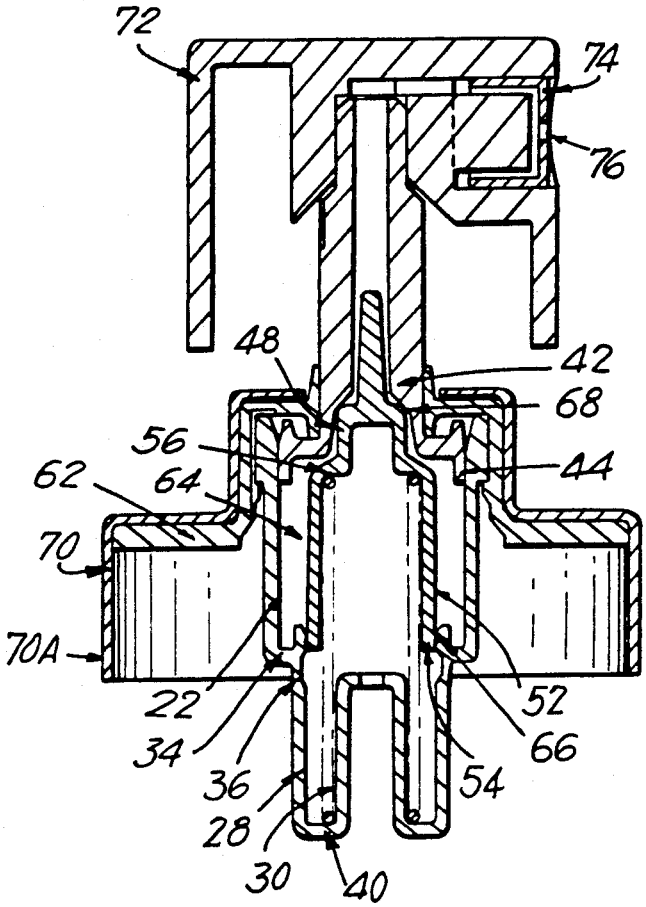
FIG. 3
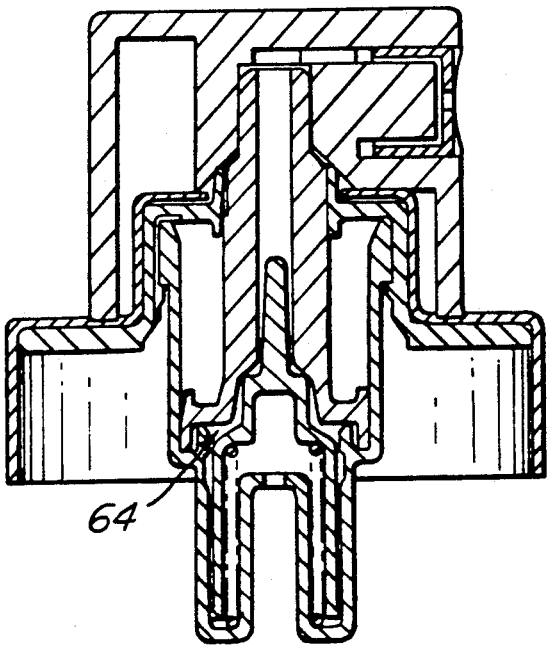

FIG. 4
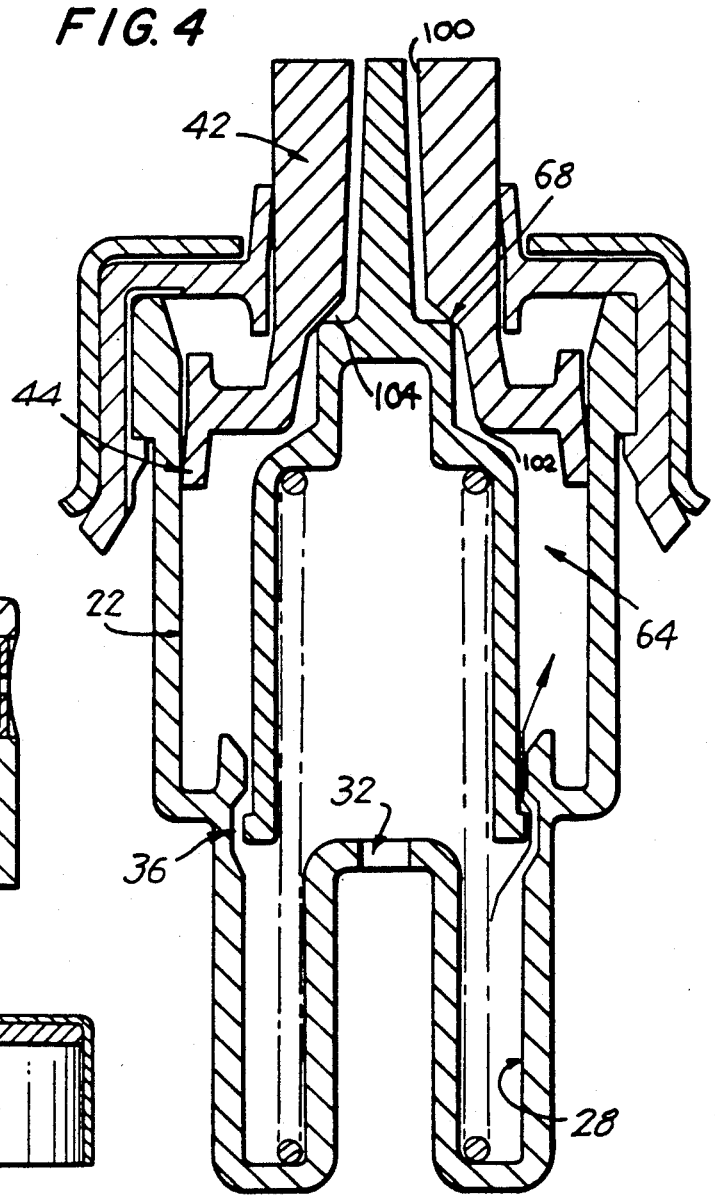
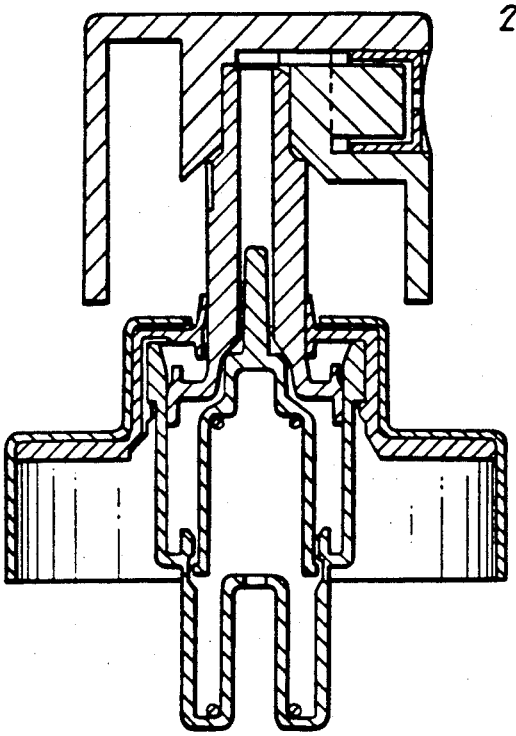
FIG. 4A

PUMP DISPENSER HAVING INLET AND OUTLET PORTS WHICH ARE HELD CLOSED DURING PERIODS OF NON USE

This is a division of application Ser. No. 07/441,893, filed on Nov. 27, 1989, now U.S. Pat. No. 5,020,696.

CROSS REFERENCE TO COPENDING APPLICATION

The present application is related to copending application entitled "ATOMIZING FLUID DISPENSER TWO" now U.S. Pat. No. 5,020,696, and owned by the assignee of the present application.

BACKGROUND OF THE INVENTION

The present invention relates to atomizing dispensers which are adapted to be secured to containers filled with fluids and which are manually operated to dispense such fluids. Typically such dispensers have actuators which are normally in raised position and which are manually depressed in order to initiate the discharge of a quantity of fluid from a container. When the manual pressure is removed, the actuators are automatically returned to the normal raised position. Known dispensers of this type utilize inlet and outlet ports. These inlet ports are open during periods of non use. As a result, the contents of the dispensers may in time be drained back into the container.

The present invention is directed toward atomizing dispensers which overcome this difficulty. More particularly, the present invention is directed toward atomizing dispensers wherein both inlet and outlet ports are held closed during periods of non use, this preventing the contents of these dispensers from being drained back into the containers.

SUMMARY OF THE INVENTION

An atomizing dispenser for dispensing fluid from a container of this fluid in accordance with the principles of this invention employs a vertical hollow elongated body having a vertical axis. The body has an upper section defining a first hollow vertical cylinder having a top opening and a lower section. The lower section defines a second outer hollow vertical cylinder having a diameter smaller than that of the first cylinder and a third inner hollow vertical cylinder concentric with and spaced inwardly from the second cylinder. The second and third cylinders are joined together at their lower ends. The upper end of the third cylinder is disposed below the upper end of the second cylinder and has an aperture therein. The upper end of the second cylinder is open. The lower end of the first cylinder curves inwardly to merge with the upper end of the second cylinder. The inner cylindrical surface of the second cylinder has a horizontally extending groove disposed therein in a region adjacent but below the region of merger of the first and second cylinders.

A hollow piston has upper and lower open ends and has an axis coincident with the body axis. The piston is vertically movable along its axis with the lower end of the piston slidably engaging the inner surface of the upper section of the body.

A vertical member having an axis coincident with the body axis is vertically movable along its axis between fully raised and fully lowered positions. The member has an upper section extending through the lower end of the piston into the interior thereof. The member has an integral middle section which is enlarged with respect to the upper section and an integral lower section which is further enlarged. The lower member section defines a fourth vertical hollow cylinder which is disposed between the second and third cylinders and has an open lower end. The fourth cylinder has an inwardly extending horizontal shoulder at its upper end and has a diameter which is slightly less than that of the second cylinder and is larger than that of the third cylinder. The lower end of the fourth cylinder slidably engages the inner surface of the upper end of the second cylinder when the member is fully raised and is disposed adjacent the joined lower ends of the second and third cylinders when the member is fully lowered.

Spring means disposed within the body bears against the joined lower ends of the second and third cylinders and extends upwardly into the fourth cylinder to bear against the shoulder. The spring means has fully extended and fully compressed positions.

A pump chamber is defined by a hollow vertical region bounded by adjacent portions of the body, piston and member. The region in horizontal cross section defines a hollow circular annulus centered on the body axis. The chamber cooperates with these adjacent portions to establish a first chamber port for fluid entry and a second chamber port for fluid discharge.

The first port is formed between the fourth cylinder and the horizontal groove in the second cylinder, being open when the lower end of the fourth cylinder is aligned with the groove and being closed when the lower end of the fourth cylinder is out of alignment with the groove. The second port is formed between the middle member section and the piston, being open when the piston is separated from the middle member section and being closed when the upper member section and the piston are engaged.

The chamber, after the dispenser is primed, is normally filled with fluid and is sealed at both ports to prevent fluid from leaking out of the chamber when the piston, member and sleeve are in fully raised positions. The first port is at least partially unsealed to allow fluid to enter the chamber when the member is being raised from fully lowered to fully raised position, the lower end of the fourth cylinder is aligned with the horizontal groove and the middle member section and piston are engaged. The second port is at least partially unsealed to allow fluid to be discharged from the chamber when the member is being lowered from fully raised to fully lowered positions and the middle member section is disengaged from the piston.

Actuator means is provided with a fluid discharge orifice and has an axis coincident with the body axis. The actuator means is disposed above and engages the piston in a normal fully raised position at which the sleeve and piston are in fully raised positions, both chamber ports are sealed and the spring means is in fully extended position. The actuator means, when subjected to downward pressure, establishes a force which moves the piston, member and sleeve downwardly, with the piston and upper member section being disengaged, thereby producing a spray discharge of fluid through the discharge orifice until the piston and upper member section are engaged in fully lowered positions and the spring means is in fully compressed position. The spring means, when the downward pressure on the actuator means is released, automatically returns to its fully extended position, thereby returning the actuator means to its normal raised position.

As will be explained in more detail hereinafter, after the dispenser is connected to the container, the dispenser need only be primed once. Thereafter the chamber is automatically filled with fluid and is sealed so that the fluid will not leak out either to the atmosphere or back into the container. When the actuator is depressed, the fluid in the chamber will be forced out as a discharge through the discharge orifice. When the actuator is released, the spring means returns the actuator to its original position and at the same time fluid is drawn into the chamber to fill it and the chamber is then sealed automatically.

BRIEF DESCRIPTION OF THE DRAWINGS

FIG. 1 is an exploded view of a preferred embodiment of the invention.

FIG. 2 is a vertical cross sectional assembled view of the structure of FIG. 1 shown in rest position.

FIG. 3 is a view similar to FIG. 2 but showing the embodiment at the completion of the down stroke.

FIG. 4 is a cross sectional view illustrating a partially completed up stroke during a priming operation.

DETAILED DESCRIPTION OF PREFERRED EMBODIMENTS

Figure 5:
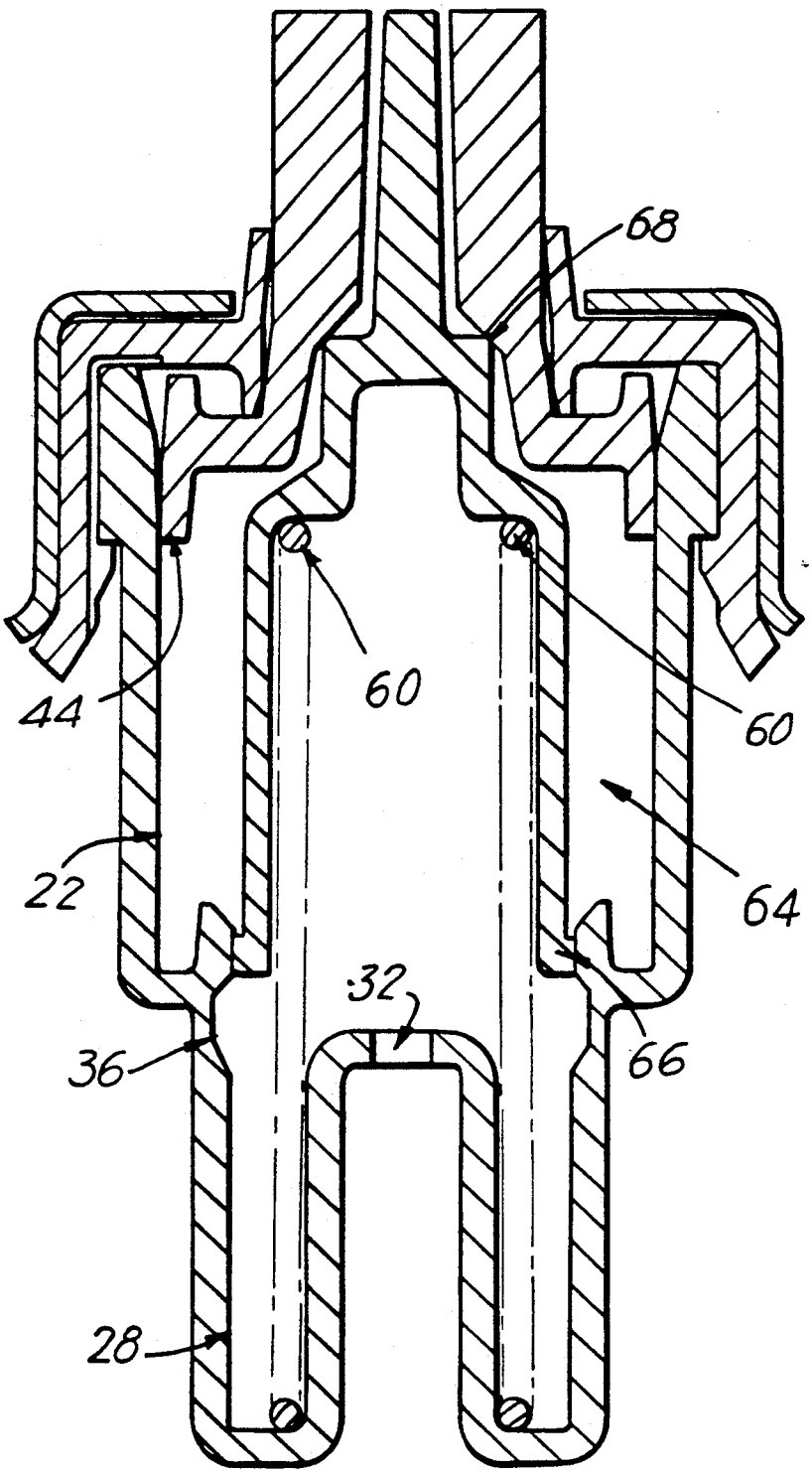
FIG. 5 is an enlarged detail view of the structure of FIG. 1.

As shown in FIGS. 1–6, an atomizing dispenser for dispensing incompressible fluid from a container of such fluid utilizes a vertical hollow elongated body 20 having a vertical axis. The body has an upper section defining a first vertical hollow cylinder 22 with a top opening 24 surrounded by an outer horizontal lip 26. The body has a lower section defining a second vertical hollow cylinder 28 having a diameter smaller than that of the first cylinder and a third cylinder 30 concentric with and spaced inwardly from the second cylinder. The upper end of the third cylinder is disposed below the upper end of the second cylinder and has an aperture 32 therein. The lower end of the first cylinder curves inwardly to merge with the upper end of the second cylinder, forming therewith an inner circular groove 34. The inner surface of cylinder 28 in a region adjacent but below the region of merger 34 is provided with a horizontally extending groove 36 therein. The lower ends of cylinders 28 and 30 are joined together at annular surface 40.

A hollow piston 42 has upper and lower open ends and has an axis coincident with the body axis. The piston is vertically movable along its axis with the lower end of the piston being provided with an outer peripheral skirt 44 which slidably engages the inner surface of the open upper section of the body. The lowest position of the piston is reached when skirt 44 engages groove 36. Piston 42 has an interior continuous bore with an upper bore region 100 and a lower bore region 102, the lower region 102 being enlarged as compared to upper region 100. These two regions are interconnected by a transition 104 which slopes inwardly and upwardly.

A vertical member 46 has an axis coincident with the body axis and has an upper section 48 integral with an enlarged middle section 50 and a further enlarged lower section having a lower end with an outer circular lip 54. The upper section 48 extends through the lower end of the piston into the hollow interior thereof. The lower section defines a fourth vertical hollow cylinder 52 disposed between cylinders 28 and 30 and having an open lower end. Cylinder 52 has an inwardly extending horizontal shoulder 56 at its upper end. Cylinder 52 has a diameter which is slightly less than that of cylinder 28 and is larger than that of cylinder 30. The outer lip 54 of cylinder 52 slidably engages the inner surface of the upper end 58 of cylinder 28 when the member is fully raised and is disposed against joined ends 40 of cylinders 28 and 30 when the member is fully lowered.

A spring 60 has an axis coincident with the body axis and is disposed within the body to bear against the joined ends 40 of cylinders 28 and 30 and against the shoulder 56. The spring has a fully extended position when the dispenser is in rest position and has a fully compressed position when the dispenser is positioned at the bottom of the down stroke. When the dispenser is in rest position, the spring forces the middle member section 50 into locking engagement with the upper end of the sleeve.

A hollow collar 62 has an axis coincident with the body axis and has a larger open lower end and a smaller open upper end, the upper end of the body extending through the lower end of the collar and abutting the upper end of the collar. The piston extends slidably through the upper end of the collar.

A pump chamber 64 is formed by a hollow region bounded by adjacent portions of the body, piston and member. This region in horizontal cross section has the general shape of a ring or other annular structure centered on the body axis. As viewed in vertical cross section, the structure has an outer wall adjacent the body which is of generally cylindrical shape and an inner wall adjacent cylinder 52 which is also of generally cylindrical shape, the radius of the outer wall being larger than the radius of the inner wall.

The chamber cooperates with the adjacent portions of the body, member, and piston to form a first chamber port 66 for fluid entry and a second chamber port 68 for fluid discharge. The chamber, after the dispenser is primed, is normally be filled with fluid and is sealed at both ports to prevent fluid from leaking out of the chamber when the piston and member are in fully raised positions.

The first port 66 is formed between the lip 54 of cylinder 52 and the groove 36 in the inner surface of cylinder 28. Port 66 is open when lip 54 is aligned with groove 36 and is closed when lip 54 is out of alignment with groove 36. The second port 68 is formed between the middle member section 50 and the piston 42. Port 68 is open when section 50 is disengaged from piston 42 and is closed when piston 42 engages section 50. Port 66 is at least partionally unsealed to allow fluid to enter the chamber when the member is being raised from fully lowered to fully raised position and the middle member section 50 and piston 42 are engaged. The second port 68 is at least partially unsealed to allow fluid to be discharged from the chamber when the member is being lowered from fully raised to fully lowered position and the middle member section is disengaged from the piston.

A mounting cup 70 has an axis coincident with the body axis. It takes the form of a lower hollow cylinder 70A having an open bottom end which is surmounted by an upper hollow cylinder 70B of smaller radius and having an upper end with a circular opening. Cylinder 70B has an open lower end engaging the upper closed end of cylinder 70A. This closed end has a circular opening aligned with the opening in the upper end of cylinder 70B. The collar 62 is fitted within the cup. When the dispenser is in rest position, the piston extends upwardly through the collar and cup. When the dispenser is in use, the cup engages the top of the open neck of a vertically disposed container filled with fluid.

An actuator 72 having the general shape of an inverted hollow cup is provided with a side mounted insert 74 having a fluid discharge orifice 76. The actuator has an axis coincident with the body axis. The actuator is disposed above and engages the top end of the piston while being aligned with and disposed above cylinder 70B in a normal fully raised position at which the member and piston are in fully raised positions, both chamber ports are sealed and the spring means is in fully extended position.

The actuator, when subjected to downward pressure, is moved into engagement with the cylinder 70B, establishing an hydraulic force which moves the piston, member and sleeve downwardly with the piston and middle member section disengaged, thereby producing a spray discharge of fluid through the orifice, until the piston and middle member section are engaged in fully lowered positions and the spring is in fully compressed position. The spring, when the downward pressure on the actuator is released, automatically returns to its fully extended position, thereby returning the actuator to its normal raised position.

The operation of the dispenser will be described on the assumption that the dispenser has been primed previously and has then been operated in such manner that the chamber is filled with fluid.

DISPENSER OPERATION

As shown in FIG. 2, the piston skirt 44 and member lip 54 seal against the body 20. The upper end of the chamber 64 has a second port 68 which is closed because the spring 60 biases the middle member section 50 against the piston. Aperture 32 which communicates via a dip tube to the fluid in the container is sealed off at a first port 66 since lip 54 is out of alignment with groove 36 and blocks passage of fluid between lip 54 and the upper end of cylinder 28. Thus, the chamber, filled with fluid, is completely sealed, both ports being closed, preventing leakage when the dispenser is at rest.

Figure 6:
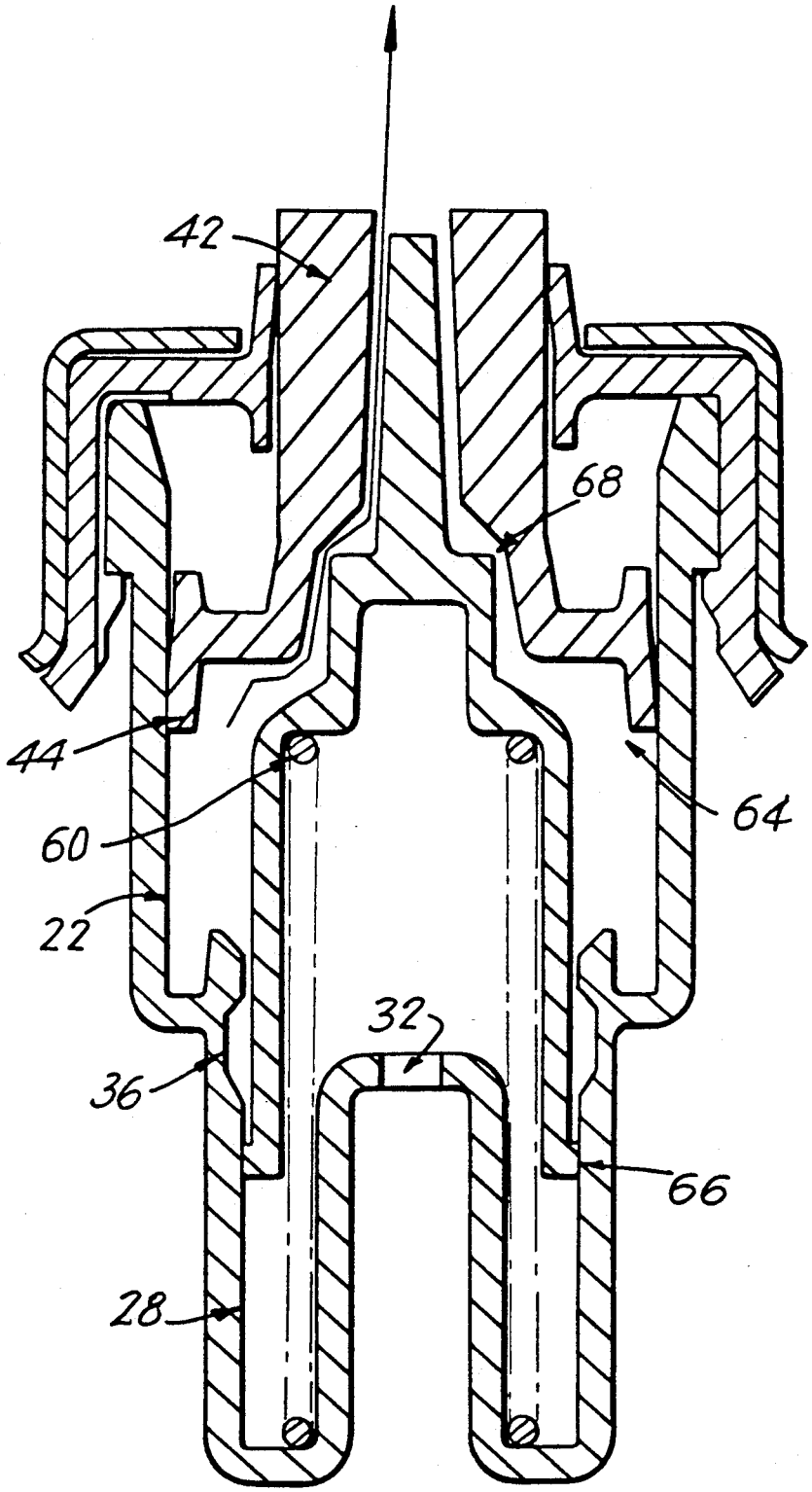
FIG. 6 is a cross sectional view illustrating a partially completed down stroke.

Referring now to FIG. 6, during the downstroke, the piston 42 and member 46 move together, reducing the volume in the main pump chamber 64. The fluid contained within the chamber creates forces on surrounding surfaces proportional to their areas. When the total force acting on the area of the cylinder 52 which is exposed to the pump chamber 64 exceeds the opposite force of the spring, the member moves downwardly together away from the piston, opening the port 68. The pump then sprays, thus dispensing the fluid.

At the bottom of the downstroke, the piston skirt 44 approaches the groove 36. The dispensing action continues until the piston engages the middle member section, closing port 68.

Once the downward pressure on the actuator has been released, the spring expands. The volume of the chamber, which has been reduced to a minimum at the completion of the downstroke, begins to increase. The negative pressure [suction] within the chamber creates an onward force onto the area of the piston 42 which is exposed to the pump chamber, exerting a force opposing the force of the spring. The force of the spring is chosen so that it is insufficient to fully return the member and the piston to their topmost positions as long as the spring force is opposed by the force exerted onto the piston by the suction. The negative pressure within the pump chamber is relieved as the lip 54 passes the groove 36 as shown in FIG. 4. At this moment, the fluid is drawn into the chamber 54, the downward force onto the piston is removed and the spring force is sufficient to return the piston and member to their topmost positions, thus closing port 66. As shown in FIGS. 4 and 5, suction force thus pulls fluid up through the dip tube and orifice 32, through the open port 66 and into the chamber. Ports 66 and 68 return to sealed position at the top of the return stroke.

What is claimed is:

1. An atomizing dispenser for dispensing fluid from a container of this fluid, the dispenser comprising:

a vertical hollow elongated body having a vertical axis, the body having an upper section defining a first hollow vertical cylinder having a top opening and a lower section defining a second outer hollow vertical cylinder having a diameter smaller than that of the first cylinder and a third inner hollow vertical cylinder concentric with and spaced inwardly from the second cylinder, the second cylinder and the third cylinder being joined together at the lower end of the second cylinder by a horizontal annular surface, the upper end of the third cylinder being disposed below the upper end of the second cylinder and having an aperture therein, the upper end of the second cylinder being open with an inner surface adjacent the upper end defining an outwardly flaring region, the lower end of the first cylinder curving inwardly to merge with the upper end of the second cylinder;

a hollow piston having upper and lower open ends and having an axis coincident with the body axis, the piston being vertically movable along its axis with the lower end of the piston slidably engaging the inner surface of the upper section of the body while always remaining in fluid sealing engagement with this inner surface;

a vertical member having an axis coincident with the body axis and being vertically movable along its axis between fully raised and fully lowered positions, the member having an upper section extending through the lower end of the piston into the hollow interior thereof, an integral middle section which is enlarged with respect to the upper section and an integral lower section which is further enlarged, the lower section defining a fourth vertical hollow cylinder disposed between the second and third cylinders and having an open lower end, the fourth cylinder having an inwardly extending horizontal shoulder at its upper end and having a diameter which is slightly less than that of the second cylinder and is larger than that of the third cylinder, the lower end of the fourth cylinder slidably engaging the inner surface of the upper end of the second cylinder when the member is fully raised and being disposed adjacent the annular horizontal surface when the member is fully lowered, the spacing between the upper section and the interior surface of the piston constituting a vertical fluid conduit;

spring means disposed within the body to bear against the horizontal annular surface and to extend upwardly into the fourth cylinder to bear against said shoulder, the spring means having fully extended and fully compressed positions;

a pump chamber defined by a hollow vertical region bounded by adjacent portions of the body, member and piston, the region in horizontal cross section defining a hollow circular annulus centered on the body axis, the chamber cooperating with said adjacent portions to establish a first chamber port for fluid entry and a second chamber port for fluid discharge, the chamber, after the dispenser is primed, being normally filled with fluid and sealed at both ports to prevent fluid from leaking out of the chamber when the piston and member are in fully raised positions, the first port being at least partially unsealed to allow fluid to enter the chamber when the member is being raised from fully lowered to fully raised position, the second port being at least partially unsealed to allow fluid to be discharged from the chamber when the member is being lowered from fully raised to fully lowered position and the upper member section is disengaged from the piston, the lower end of the fourth cylinder being in fluid sealing engagement with the inner surface of the second cylinder at all times when the first port is fully closed; and actuator means provided with a fluid discharge orifice and having an axis coincident with the body axis, the actuator means being disposed above and engaging the piston in a normal fully raised position at which the member and piston are in fully raised position, both chamber ports are sealed and the spring means is in fully extended position, the actuator means, when subjected to downward pressure, establishing a force which moves the piston and member downwardly, thereby producing a spray discharge of fluid through the vertical fluid conduit and the discharge orifice, until the piston and middle member section are engaged in fully lowered positions and the spring means is in fully compressed position, the spring means, when the downward pressure on the actuator means is released, automatically returning to its fully extended position, thereby returning the actuator means to its normal raised position.

2. An atomizing dispenser for dispensing fluid from a container of this fluid, the dispenser comprising:

a vertical hollow elongated body having a vertical axis, the body having an upper section defining a first hollow vertical cylinder having a top opening and a lower section having a second outer hollow vertical cylinder with a diameter smaller than that of the first cylinder and a third inner hollow cylinder concentric with and spaced inwardly from the second cylinder, the second cylinder and the third cylinder being joined together at the lower end of the second cylinder by a horizontal annular surface, the upper end of the third cylinder being disposed below the upper end of the second cylinder and having an aperture therein, the lower end of the first cylinder curving inwardly to merge with the upper end of the second cylinder, the inner cylindrical surface of the second cylinder in a region adjacent but below the region of merger of the first and second cylinders having a horizontally extending groove disposed therein;

a hollow piston having upper and lower open ends and having an axis coincident with the body axis, the piston being vertically movable along its axis with the lower end of the piston slidably engaging the inner surface of the upper section of the body while always remaining in fluid sealing engagement therewith;

a vertical member having an axis coincident with the body axis and being vertically movable along its axis between fully raised and fully lowered positions, the member having an upper section extending through the lower end of the piston into the hollow interior thereof, an integral middle section which is enlarged with respect to the upper section and an integral lower section which is further enlarged, the lower section defining a fourth vertical hollow cylinder disposed between the second and third cylinders and having an open lower end, the fourth cylinder having an inwardly extending horizontal shoulder at its upper end and having a diameter which is slightly less than that of the second cylinder and is larger than that of the third cylinder, the lower end of the fourth cylinder being disposed adjacent the upper end of the second cylinder when the member is fully raised and being disposed adjacent the horizontal annular surface when the member is fully lowered, the lower end of the fourth cylinder being always in fluid sealing engagement with the inner surface of the second cylinder except when the lower end of the fourth cylinder is in alignment with the horizontal groove, the separation between the upper section and the interior surface of the second cylinder constituting a vertical fluid conduit;

spring means disposed within the body to bear against the horizontal annular surface and to extend upwardly into the fourth cylinder to bear against said shoulder, the spring means having fully extended and fully compressed positions;

a pump chamber defined by a hollow vertical region bounded by adjacent portions of the body, member and piston, the region in horizontal cross section defining a hollow circular annulus centered on the body axis, the chamber cooperating with said adjacent portions to establish a first chamber port for fluid entry and a second chamber port for fluid discharge, the first port being formed between the lower end of the fourth cylinder and the horizontal groove, the first port being open when the lower end of the fourth cylinder is aligned therewith and being closed when the lower end of the fourth cylinder is out of alignment with the horizontal groove, the second port being formed between the middle member section and the piston, the second port being opened when the piston is separated from the middle member section and being closed when the piston and middle member section are engaged, the chamber, after the dispenser is primed, being normally filled with fluid and sealed at both ports to prevent fluid from leaking out of the chamber when the piston and member are in fully raised positions, the first port being at least partially unsealed to allow fluid to enter the chamber when the member is being raised from fully lowered to fully raised position, the lower end of the fourth cylinder is aligned with the horizontal groove and the middle member sectión and piston are engaged, the second port being at least partially unsealed to allow fluid to be discharged from the chamber when the member is being lowered from fully raised to fully lowered position and the upper member section is disengaged from the piston; and actuator means provided with a fluid discharge orifice and having an axis coincident with the body axis, the actuator means being disposed above and engaging the piston in a normal fully raised position at which the member and piston are in fully raised position, both chamber ports are sealed and the spring means is in fully extended position, the actuator means, when subjected to downward pressure, establishing a force which moves the piston and member downwardly with the piston and middle member section being disengaged, thereby producing a spray discharge of fluid upwardly through the vertical fluid conduit and the discharge orifice, until the piston and middle member section are engaged in fully lowered positions and the spring means is in fully compressed position, the spring means, when the downward pressure on the actuator means is released, automatically returning to its fully extended position, thereby returning the actuator means to its normal raised position.

3. The dispenser of claim 1 wherein the piston has an interior continuous bore with upper and lower bore regions, the lower bore region being enlarged as compared to the upper bore region, the middle section of the member being adapted to engage the lower bore region of the piston but being too large to engage the upper region of the piston.

4. The dispenser of claim 3 wherein the upper and lower bore regions of the piston are interconnected by a transition which slopes inwardly and upwardly, the second port being closed when the middle section of the member engages the transition in the bore of the piston.

* * * * *